US006362743B1

(12) United States Patent
Tanguay et al.

(10) Patent No.: US 6,362,743 B1
(45) Date of Patent: Mar. 26, 2002

(54) SMOKE ALARM WITH DUAL SENSING TECHNOLOGIES AND DUAL POWER SOURCES

(75) Inventors: William P. Tanguay, Downers Grove; Thomas W. Kondziolka, Chicago, both of IL (US)

(73) Assignee: Ranco Incorporated of Delaware, Wilmington, DE (US)

( * ) Notice: Subject to any disclaimer, the term of this patent is extended or adjusted under 35 U.S.C. 154(b) by 0 days.

(21) Appl. No.: 09/634,972

(22) Filed: Aug. 9, 2000

Related U.S. Application Data

(60) Provisional application No. 60/153,139, filed on Sep. 9, 1999.

(51) Int. Cl.[7] ..... G08B 17/10

(52) U.S. Cl. ..... 340/630; 340/578; 340/579; 340/629; 340/693.2; 250/384; 356/338; 356/339

(58) Field of Search ..... 340/578, 628, 340/629, 630, 527, 579, 693.2; 250/384; 356/338, 339

(56) References Cited

U.S. PATENT DOCUMENTS

| | | | | | |
|---|---|---|---|---|---|
| 4,065,759 | A | * | 12/1977 | Handing | 340/628 |
| 4,225,860 | A | | 9/1980 | Conforti | 340/629 |
| 4,257,039 | A | | 3/1981 | Webb et al. | 340/629 |
| 4,305,069 | A | * | 12/1981 | Machen et al. | 340/629 |
| 4,316,184 | A | * | 2/1982 | Nagel | 340/630 |
| 4,401,978 | A | * | 8/1983 | Solomon | 340/629 |
| 4,405,919 | A | * | 9/1983 | Scheidweiler | 340/628 |
| 4,420,746 | A | * | 12/1983 | Malinowski | 340/630 |
| 5,557,262 | A | | 9/1996 | Tice | 340/587 |
| 5,633,501 | A | * | 5/1997 | Amleshi et al. | 340/628 |

FOREIGN PATENT DOCUMENTS

| | | |
|---|---|---|
| GB | 2006554 | 5/1979 |
| GB | 2043977 | 10/1980 |
| GB | 2078414 | 1/1982 |
| GB | 2269494 | 2/1994 |
| GB | 2305760 | 4/1997 |
| GB | 2312312 | 10/1997 |

OTHER PUBLICATIONS

"Photoelectric Smoke Detector With Interconnect and Timer", 5358, Data Sheet 26110.10A, Allegro MicroSystems, Inc. 1995, 1996.

"Smoke Detector With Interconnect and Timer", 5368, Data Sheet 26110.8, Allegro MicroSystems, Inc. 1998.

* cited by examiner

*Primary Examiner*—Daniel J. Wu
(74) *Attorney, Agent, or Firm*—Andrus, Sceales, Starke & Sawall, LLP

(57) ABSTRACT

A smoke alarm having both an ionization detector and a photoelectric detector coupled to each other to generate an alarm signal when either of the detectors senses a potential fire. The smoke detector includes a power supply circuit having both an AC power supply and a DC battery power supply. During normal operating conditions, the AC power supply operates both the ionization detector and the photoelectric detector of the smoke alarm. Upon power interruption, the DC battery supply provides power to operate both the ionization detector and the photoelectric detector. The smoke alarm includes an interconnect that allows multiple smoke alarms to be coupled together.

12 Claims, 5 Drawing Sheets

SMOKE ALARM WITH DUAL SENSING TECHNOLOGIES AND DUAL POWER SOURCES

CROSS-REFERENCE TO RELATED APPLICATIONS

This application is based on and claims priority from Provisional Application Number 60/153,139 filed on Sep. 9, 1999.

BACKGROUND OF THE INVENTION

The present invention generally relates to smoke alarms. More specifically, the present invention relates to a smoke alarm that includes both an ionization smoke detector and a photoelectric smoke detector and includes a dual power source having both an AC power supply and a DC power supply.

Currently, two types of smoke alarms are available on the market. The first type of smoke alarm incorporates photoelectric smoke-sensing technology in which light from an emitter source, such as an infrared light-emitting diode (LED), is directed away from a light-detecting device. When smoke is present within the photo-detecting chamber, the emitted light contacts the smoke particles and is reflected and detected by the photo detector. When enough light is reflected by smoke particles, the signal generated by the photo detector activates an audible alarm.

A second type of currently available smoke alarm utilizes ionization smoke-sensing technology. A smoke alarm incorporating an ionization detector includes an ionization chamber that encloses a pair of electrodes having a voltage generated thereacross. When a fire is present near the smoke alarm, the combustion products enter the ionization chamber and the voltage across the pair of electrodes is altered. The altered voltage across the electrodes is provided to a control circuit that activates an audible alarm to indicate a smoke or fire condition.

Although photoelectric smoke alarms and ionization smoke alarms are both commercially available, each type of alarm has unique operating characteristics that makes each type of alarm better at detecting a different type of fire or smoke condition. As is commonly known, a photoelectric smoke alarm is generally more effective at detecting a slow, smoldering fire that smolders for hours before bursting into flames. In a smoldering fire, a great deal of smoke is created but very little flame is present. Smoldering fires may be caused by cigarettes burning in couches or bedding. Although a smoldering fire can and often will progress into a flaming fire, it is desirable that the occupants be alerted to the existence of the smoldering fire as soon as possible. Photoelectric smoke alarms are best at detecting this type of fire.

An ionization smoke detector is generally more effective at detecting fast, flaming fires which consume combustible materials rapidly and spread quickly. Sources of these types of fires may include paper burning in a waste container or a grease fire in the kitchen. Again, it is desirable to alert a home occupant to the existence of this type of fire as soon as possible, and an ionization detector is most effective in this regard.

Since the mid-1980s, a dual sensing smoke alarm that includes both an ionization detection system and photoelectric detection system has been known and commercially available In 1997, the Maple Chase Company of Downers Grove, Ill., introduced the Firex Model CCPB with dual ionization and photoelectricsensing technology. In each of the commercial dual-sensing smoke alarms mentioned above, the power supply is a 9-volt battery. Additionally, U.S. Pat. Nos. 4,316,184 and 5,633,501 disclose a smoke alarm that includes both photoelectric and ionization smoke detectors.

Smoke alarms that include either an ionization smoke detector or a photoelectric smoke detector are also available that utilize two power sources; an AC main power source and a DC battery back-up. The dual power sources allow the smoke alarm to operate from AC power during normal conditions. However, if AC power is lost, such as while the residents of the home are sleeping, the DC battery back-up will allow the smoke alarm to remain active and generate an alarm during smoke conditions.

Many current local fire protection codes requires that new home constructions include interconnected smoke alarms within a house so that the sensing of smoke by one alarm is transmitted to all the interconnected alarms. Each of these interconnected smoke alarms are powered by an AC power source and interconnected by wiring within the home.

Although individual battery-powered smoke alarms having both ionization and photoelectric-sensing systems and individual smoke alarms having one type of detection system and dual power sources are both currently available, a need exists for a single smoke alarm that includes both photoelectric and ionization smokesensing technology and a dual AC and DC power supply system. Therefore, it is an object of the present invention to provide a smoke alarm that includes both ionization and photoelectric smoke-sensing technology as well as dual power supply connections to both AC and DC power. Further, it is an object of the present invention to provide a smoke alarm that interconnects the photoelectric and ionization detection systems such that a single button can be depressed to test both the ionization and photoelectric-sensing systems. Further, it is an object of the present invention to provide a smoke alarm that interconnects the ionization and photoelectric smokedetecting systems such that either system generates an alarm condition upon smoke detection.

SUMMARY OF THE INVENTION

The present invention is a smoke alarm that includes two different distinct types of smoke detectors and two distinct power supply connections. The smoke alarm of the present invention generates an alarm when either one or both of the two distinct smoke sensing detectors signal a potential fire condition.

The smoke alarm of the present invention includes a photoelectric detector having a detector chamber and a photo control circuit. When the detector chamber of the photoelectric detector senses a potential fire, the photo control circuit of the photoelectric detector generates an alarm signal. The photoelectric detector of the smoke alarm is particularly effective at detecting a slow, smoldering fire.

The smoke alarm of the present invention also includes an ionization detector. The ionization detector includes a detector chamber and an ionization control circuit connected to the detector chamber. When smoke particles are received within the detector chamber, the detector chamber signals the ionization control circuit to generate an alarm signal indicating a detected fire. The ionization detector is particularly effective at quickly detecting fast, flaming fires.

The smoke alarm of the present invention further includes an audible alarm that is activated upon generation of an alarm signal from either the ionization detector or the photoelectric detector. Thus, the single audible alarm can be activated by detection of a fire by either the photoelectric detector or the ionization detector.

In the first embodiment of the invention, the photoelectric detector acts as the "slave" in a master-slave relationship with the ionization detector. When the photoelectric detector senses a potential fire, the photoelectric detector provides an alarm signal to the ionization detector signaling the sensed fire. Upon receipt of the alarm signal from the photoelectric detector, the ionization detector activates the audible alarm coupled to the ionization control circuit of the ionization detector. In addition to activating the audible alarm upon receiving the alarm signal from the photoelectric detector, the ionization control circuit activates the audible alarm when the ionization detector senses a potential fire.

In a second embodiment of the invention, the ionization detector acts as the "slave" in a master-slave relationship with the photoelectric detector. In the second embodiment of the invention, when the ionization detector senses a potential fire, the ionization detector generates an alarm signal that is received by the control circuit of the photoelectric detector. Upon receiving the alarm signal from the ionization detector, the photoelectric detector activates the audible alarm to signal a potential fire. In addition to activating the audible alarm upon receipt of the alarm signal from the ionization detector, the control circuit of the photoelectric detector activates the audible alarm when the photoelectric detector itself senses a potential fire condition.

In both the first and second embodiments of the invention, a multiple station interconnect is included in the smoke alarm. The multiple station interconnect allows multiple smoke alarms to be connected within a household such that when any of the joined alarms senses a fire condition, the sensed fire condition activates each of the joined alarms.

The smoke alarm of the present invention further includes a power supply circuit that is connected to both the photoelectric detector and the ionization detector. The power supply circuit of the present invention includes both an AC power supply and a DC power supply. Preferably, the DC power supply is a conventional 9 volt battery.

The power supply circuit is configured such that whenever the AC power supply is available and operating properly, the AC power supply provides the electric power to operate both the ionization detector and the photoelectric detector.

The power supply circuit is constructed such that if AC power is interrupted or removed from the power supply circuit, the power supply circuit automatically switches to the DC power supplied by the battery. In this manner, the photoelectric detector and the ionization detector are supplied with power even when the AC power supply is interrupted.

The smoke alarm of the present invention thus includes two distinct types of smoke detectors and a dual power supply in a single, integrated unit. The two types of smoke sensing technologies allow the single smoke alarm of the present invention to more quickly respond to different types of smoke conditions. The dual power supply connections allow the single smoke alarm to operate properly when AC power is present or if the AC power supply is interrupted.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE DRAWINGS

Figure 1:
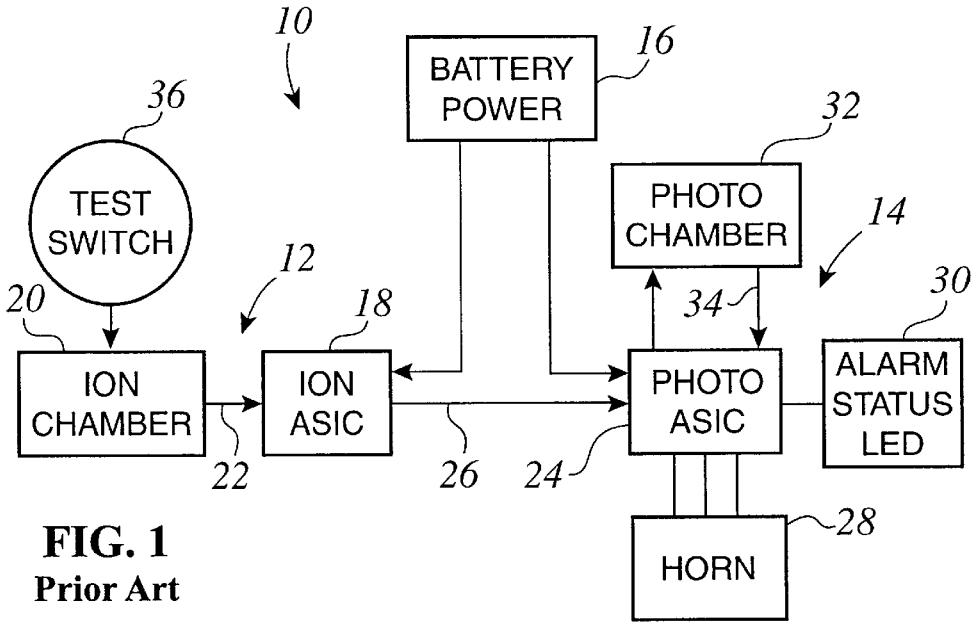
FIG. 1 Prior Art
FIG. 1 is a schematic illustration of a prior art smoke alarm including dual smoke sensing technologies and a battery power source.

Referring first to FIG. 1, thereshown is a schematic illustration of a prior art smoke alarm 10 including both an ionization detector 12 and photoelectric detector 14. In the prior art dual sensing smoke alarm 10, both the ionization detector 12 and the photoelectric detector 14 are powered by a DC battery 16. The battery 16 is preferably a 9-volt battery that supplies power to both the ionization detector 12 and the photoelectric detector 14.

The ionization detector 12 shown in FIG. 1 includes an ionization control circuit 18 coupled to an ionization detector chamber 20. The ionization detector chamber 20 encloses a pair of electrodes having a voltage developed thereacross. When products of combustion enter into the ionization detector chamber 20, the voltage across the electrodes is altered. The change in the voltage across the electrodes of the ionization detector chamber 20 is sensed by the ionization control circuit 18, as illustrated by arrow 22.

In the embodiment of the invention illustrated in FIG. 1, the ionization control circuit 18 is the "slave" in a master-slave relationship with the photo control circuit 24 of the photoelectric detector 14. When the ionization control circuit 18 of the ionization detector 12 senses a predefined amount of change in the voltage from the ionization detector chamber 20, the ionization control circuit 18 sends an alarm signal to the photo control circuit 24, as illustrated by the arrow 26. When the photo control circuit 24 receives the alarm signal from the ionization detector 12, the photo control circuit 24 activates an audible alarm 28 and an alarm status (LED) 30. In this manner, the ionization detector 12 is able to indicate a sensed, potential fire by generating an alarm through the "master" photo control circuit 24 of the photoelectric detector 14.

The photoelectric detector 14 includes a photo detector chamber 32. Photo detector chamber 32 includes a light-emitting diode (LED) that directs light away from a light-responsive device, such as a photo receptor. When smoke is present in the photo detector chamber 32, a portion of the light emitted by the LED is reflected and detected by the photo receptor. The amount of light detected is relayed to the photo control circuit 24, as indicated by arrow 34. When the amount of detected light exceeds a threshold value, the photo control circuit 24 activates the audible alarm 28 to signal a sensed potential fire. In this manner, the photo control circuit 24 of the photoelectric detector 14 activates the audible alarm 28 upon detection of a potential fire by either the ionization detector chamber 20 of the ionization detector 12 or the photo detector chamber 32 of the photoelectric detector 14.

The prior art smoke alarm 10 illustrated in FIG. 1 includes a test switch 36 that can be used to test the ionization detector 12. If the ionization detector 12 is operating properly, the ionization control circuit 18 sends the alarm signal to the photo control circuit 24 of the photoelectric detector 14. The input to the photo control circuit 24 is, in actuality, the test input for the photo chamber 32. Therefore, the user test mode, enabled by test switch 36, functionally tests both the ionization chamber 20 and ionization control circuit 22 as well as the photo chamber 32 and photo control circuit 24. Upon receiving the alarm signal from the ionization detector 12, the photo control circuit 24 activates the audible alarm 28.

In the prior art smoke alarm 10 incorporating both the ionization detector 12 and the photoelectric detector 14, the smoke alarm 10 is operated solely by the DC battery power supply 16. Although the battery power supply 16 is able to adequately operate both the ionization detector 12 and the photoelectric detector 14, the battery supply 16 is not, by itself, a robust power source. Although smoke alarms have audible low-battery detection circuits and mechanical lock-outs that prevent mounting the alarm without a physical battery, a missing battery or a catastrophically defective battery would render the entire smoke alarm 10 inoperable.

Figure 2:
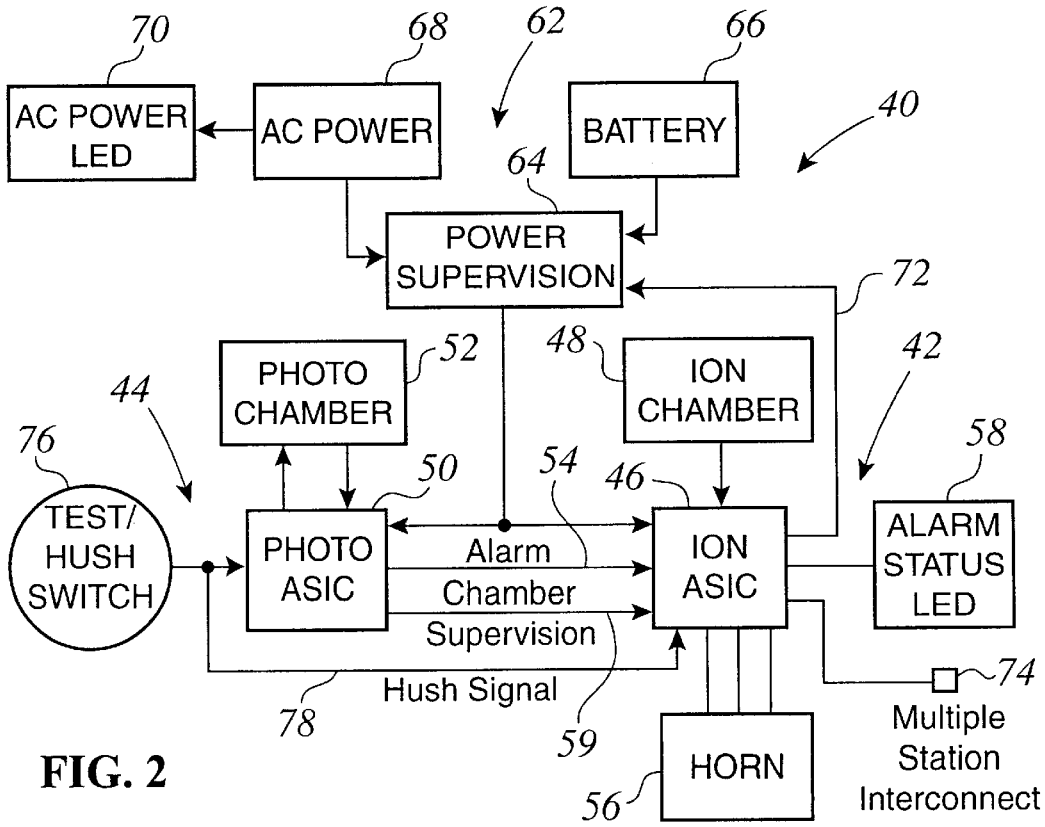
FIG. 2 is a schematic illustration of a first embodiment of the smoke alarm of the present invention including dual smoke sensing technologies and a dual power source including AC and DC power supply connections.

Referring now to FIG. 2, thereshown is a first embodiment of a smoke alarm 40 of the present invention. Smoke alarm 40 includes both an ionization detector 42 and a photoelectric detector 44. The ionization detector 42 generally includes an ionization control circuit 46 and an ionization detector chamber 48. Likewise, the photoelectric detector 44 includes a photo control circuit 50 and a photo detector chamber 52. In the embodiment of the invention illustrated in FIG. 2, the ionization control circuit 46 of the ionization detector 42 acts as the "master" control circuit, while the photo control circuit 50 of the photoelectric detector 44 serves as a "slave".

In the embodiment of the invention illustrated in FIG. 2, when smoke from a potential fire enters into the photo detector chamber 52, the change in the amount of light received by the photo receptor is converted into a voltage which is received by the photo control circuit 50. When the voltage received by the photo control circuit 50 exceeds a threshold value, the photo control circuit 50 generates an alarm signal, as indicated by arrow 54. Upon receiving the alarm signal, the ionization control circuit 46 of the ionization detector 42 activates the audible alarm 56 and the alarm status LED 58. Additionally, this embodiment indicates a control line, called chamber supervision 59, that communicates the photo control circuit 50 chamber supervision warning to the ionization control circuit 46, so that an appropriate audible signal can be generated, alerting the user to a problem with the photoelectric portion of the smoke alarm.

In addition to activating the audible alarm 56 upon receiving the alarm signal from the photo control circuit 50, the ionization control circuit 46 will activate the audible alarm 56 when the ionization detector chamber 46 detects smoke particles. Thus, the ionization control circuit 46 controls the activation of the audible alarm 56 and the alarm status LED 58 in the first embodiment of the invention illustrated in FIG. 2.

As can be seen in FIG. 2, both the ionization detector 42 and the photoelectric detector 44 are connected to a power supply circuit 62. The power supply circuit 62 includes a power supervision circuit 64, a DC battery power supply 66 and an AC power supply 68. The power supervision circuit 64 is constructed such that the AC power supply 68 provides power to the ionization detector 42 and the photoelectric detector 44 during normal operating conditions. During normal operating conditions, the AC power supply 68 operates an AC power indicating LED 70 which allows the home occupant to confirm the operating status of the AC power supply 68.

If the AC power supply 68 fails or is interrupted, the power supervision circuit 64 connects the back-up DC battery power supply 66 to both the ionization detector 42 and the photoelectric detector 44. Thus, the smoke detector 40 of the present invention includes both dual sensing technologies and dual power sources to provide a complete smoke alarm system that was unavailable in prior art systems.

As can be seen in FIG. 2, the power supervision circuit 64 includes a control line 72 that allows the ionization control circuit 46 of the ionization detector 42 to monitor the charge remaining on the back-up DC battery power supply 66.

The smoke alarm 40 includes an interconnect 74 coupled to the ionization control circuit 46. The interconnect 74 allows multiple smoke alarms 40 to be coupled to each other such that if any one of the networked smoke alarms generates an alarm signal, the alarm signal is communicated to the remaining smoke alarms which also then generate an audible alarm. The multiple station interconnect 74 allows multiple smoke alarms positioned in various locations within a home to simultaneously signal an alarm, which then can be heard from each room in which the smoke alarm is located.

The smoke alarm 40 includes a test/hush switch 76 that is coupled to both the photo control circuit 50 and the ionization control circuit 46. When the test/hush switch 76 is depressed, the photo control circuit 50 tests the photo detector chamber 52 to determine whether it is operating properly. If the photo detector chamber 52 is operating properly, the photo control circuit 50 sends an alarm signal to the ionization control circuit 46 via the ionization chamber 48. Upon receiving the alarm signal from the photo control circuit 50, the ionization control circuit 46 activates the audible alarm 56.

In addition to acting as a test switch, the test/hush switch 76 is connected directly to the ionization control circuit 46 to provide a hush signal along connection 78. In operation, when the ionization control circuit 46 is generating an audible alarm due to detection of a potential fire condition, the test/hush switch 76 can be depressed to "hush" the audible alarm for a predetermined period of time. In the embodiment of the invention illustrated in FIG. 2, the audible alarm 56 can be "hushed"for a 10-minute period by depressing the switch 76 when the audible alarm 56 is being energized by the ionization control circuit 46. The "hush" feature allows the user to temporarily desensitize the smoke alarm 40 during situations in which the operator is certain that the sensed smoke is non-dangerous, such as burnt toast in a kitchen or other type of non-dangerous and monitored smoke-producing situation. In this embodiment, the test switch 76 simultaneously enables the hush input on both the photo control circuit 50 and the ion control circuit 46, so that each of the two smoke sensing circuits will be desensitized. The test/hush switch 76 allows the user to desensitize the alarm for a brief period of time and eliminates the common situation in which the user removes the smoke alarm from service in order to take out the battery and thus quiet the alarm. The removal of the battery from the smoke alarm creates the potential that the user may forget to replace the battery and thus render the smoke alarm ineffective.

Figure 3:
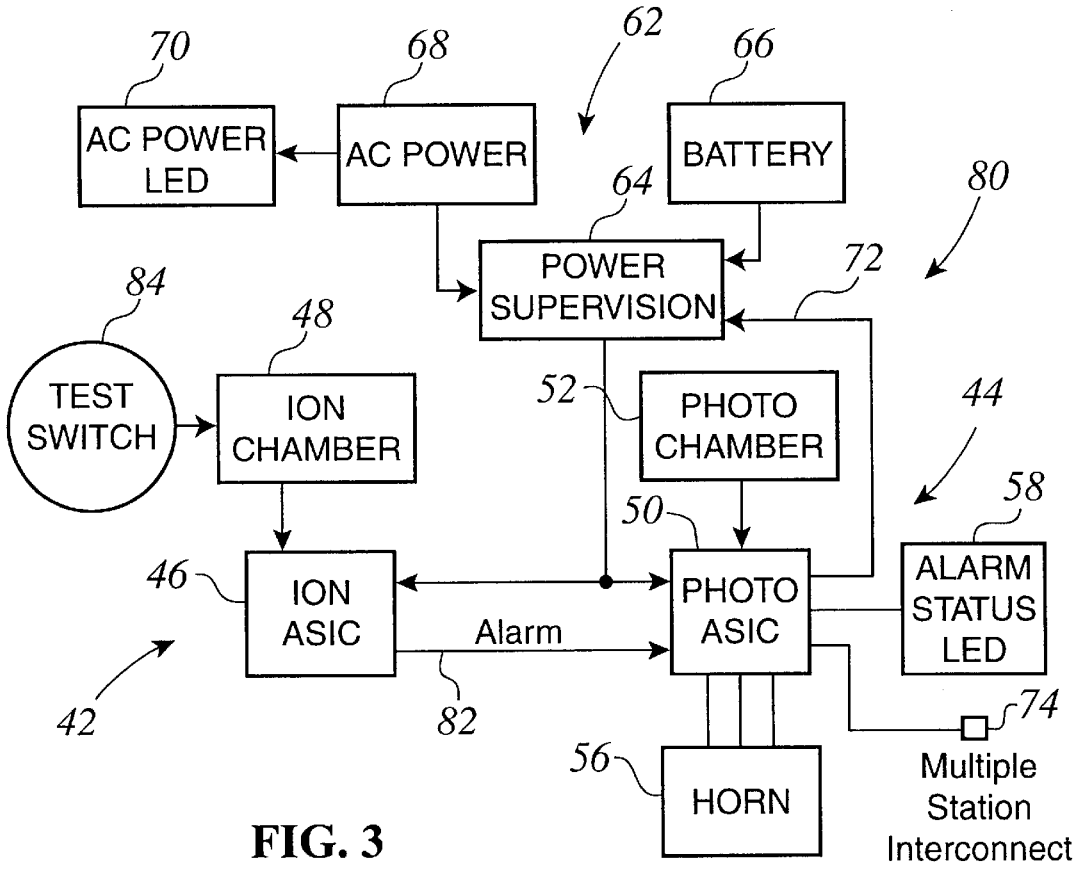
FIG. 3 is a schematic illustration of a second, preferred embodiment of the smoke alarm of the present invention including dual smoke sensing technologies and a dual power source including AC and DC power supply connections.

Referring now to FIG. 3, thereshown is a second alternate embodiment of the smoke alarm 80 of the present invention. In the alternate embodiment of FIG. 3, the photo control circuit 50 of the photoelectric detector 44 functions as the "master," while the ionization control circuit 46 of the ionization detector 42 acts as the "slave." Since many of the components of the smoke alarm 80 of the second alternate configuration are similar or identical to the first embodiment of the smoke alarm 40 shown in FIG. 2, corresponding reference numerals are used to facilitate understanding.

In the smoke alarm 80 shown in FIG. 3, the ionization control circuit 46 sends an alarm signal across line 82 to the photo control circuit 50 when the ionization detector chamber 48 senses combustion particles. Upon receiving the alarm signal, the photo control circuit 50 activates the audible alarm 56. In addition to activating the audible alarm 56 upon receiving the alarm signal, the photo control circuit 50 activates the audible alarm when the photo detector chamber 52 senses smoke particles in the manner previously discussed. Thus, the photo control circuit 50 controls the activation of the audible alarm 56 and the alarm status LED 58 in the second embodiment of the invention illustrated in FIG. 3.

In the embodiment of the invention illustrated in FIG. 3, a test switch 84 is connected to the ionization detector chamber 48 such that when the test switch 84 is depressed, the ionization detector chamber 48 generate a signal indicating the detection of combustion particles. When the test switch 84 is depressed, the ionization control circuit 46 generates the alarm signal along line 82, which is received by the photo control circuit 50. The photo control circuit 50 receives the alarm signal and activates the audible alarm 56 as well as outputting an alarm signal on the interconnect 74.

As was the case with the first embodiment of FIG. 2, the second embodiment of the invention illustrated in FIG. 3 includes the power supply circuit 62 having both the DC battery power supply 66 and the AC power supply 68, the AC power indicating LED 70 and the power supervision circuit 64. Thus, the smoke alarm 80 of the second embodiment of the invention includes dual sensing technologies and dual power supplies, as was the case in the first embodiment of FIG. 2.

Although FIGS. 2 and 3 illustrate two contemplated embodiments of the invention in which the photoelectric detector 44 and the ionization detector 42 are coupled to each other in a master-slave relationship, it is contemplated by the inventors that the two detectors could be configured in parallel such that each of the detectors could activate the audible alarm independently from the other detector. In the parallel configuration, each of the detectors would be supplied with power from both the DC battery power supply 66 and the AC power supply 68. Unlike the masterslave relationship, if either of the detectors in the parallel configuration senses a potential fire condition, the detector itself would directly activate the audible alarm and provide an alarm signal on the interconnect 74. Although a parallel configuration may require additional components and circuitry, an advantage of the parallel configuration is a reduced reliance on the proper operation of the "master" control circuit in the embodiments of the invention shown in FIGS. 2 and 3.

Figure 4A:
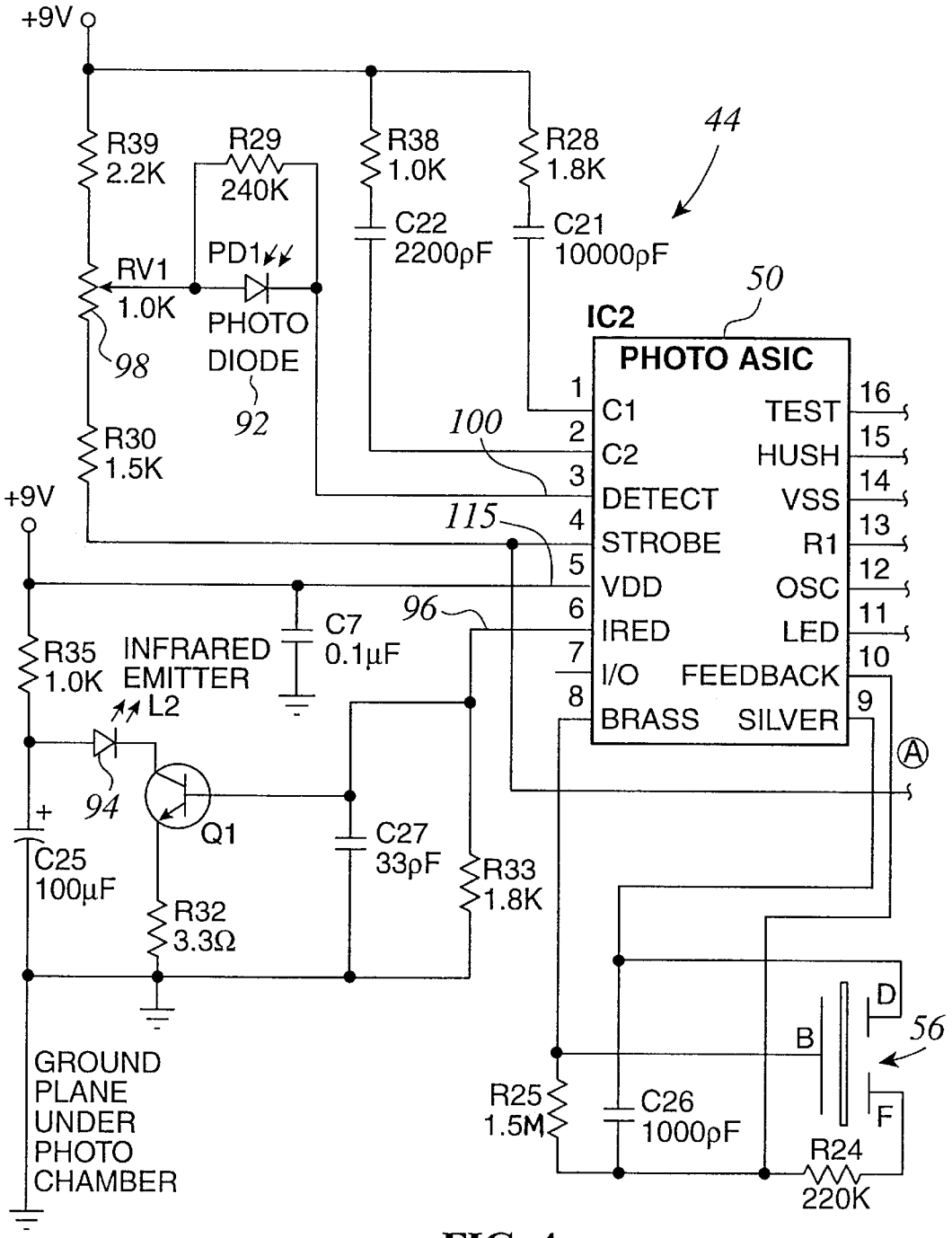
FIGS. 4*a*–4*c* represent a detailed circuit diagram illustrating the currently preferred embodiment of the smoke alarm of the present invention including dual smoke sensing technologies and a dual power source including AC and DC power supply connections.
Figure 4B:
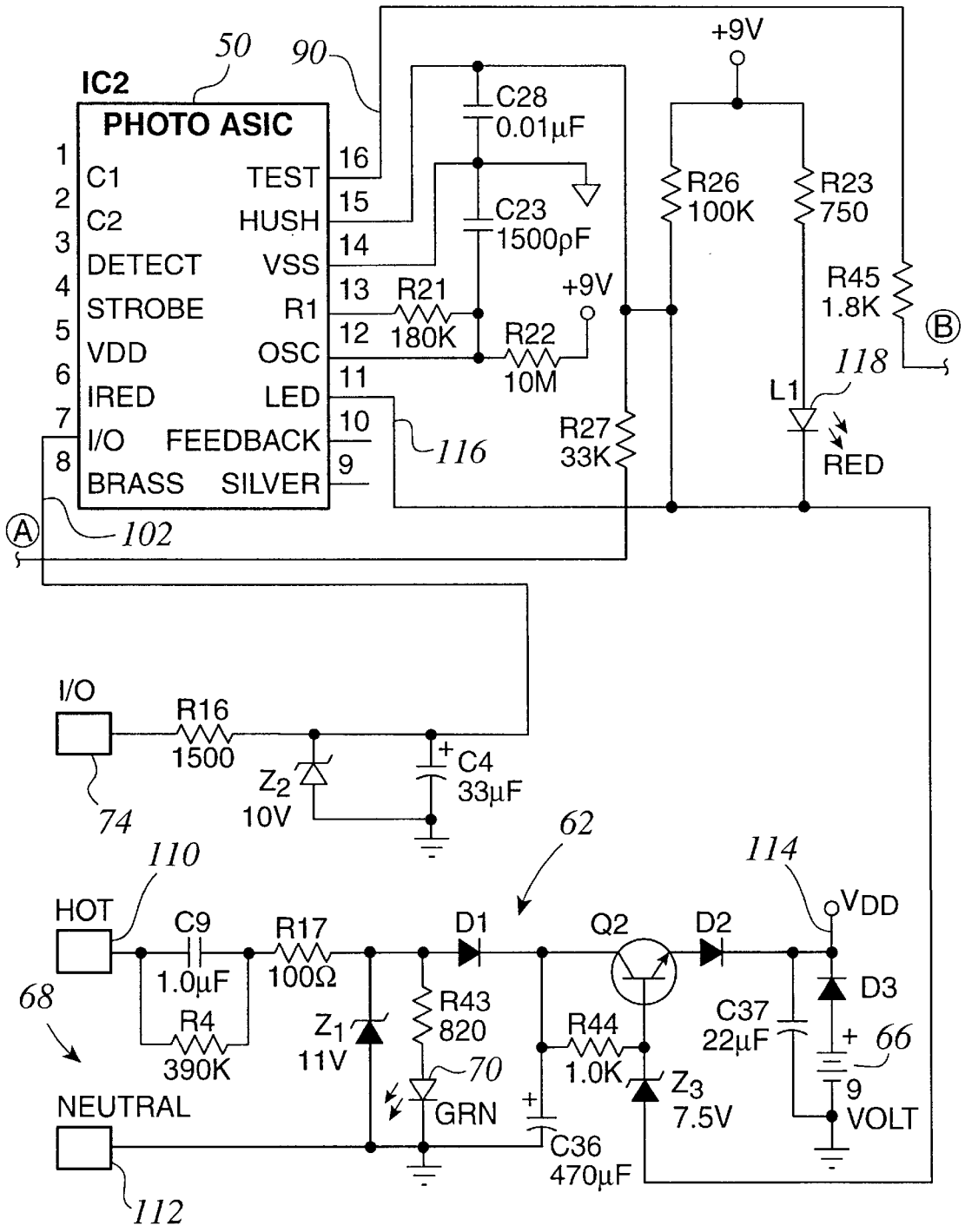
Figure 4C:
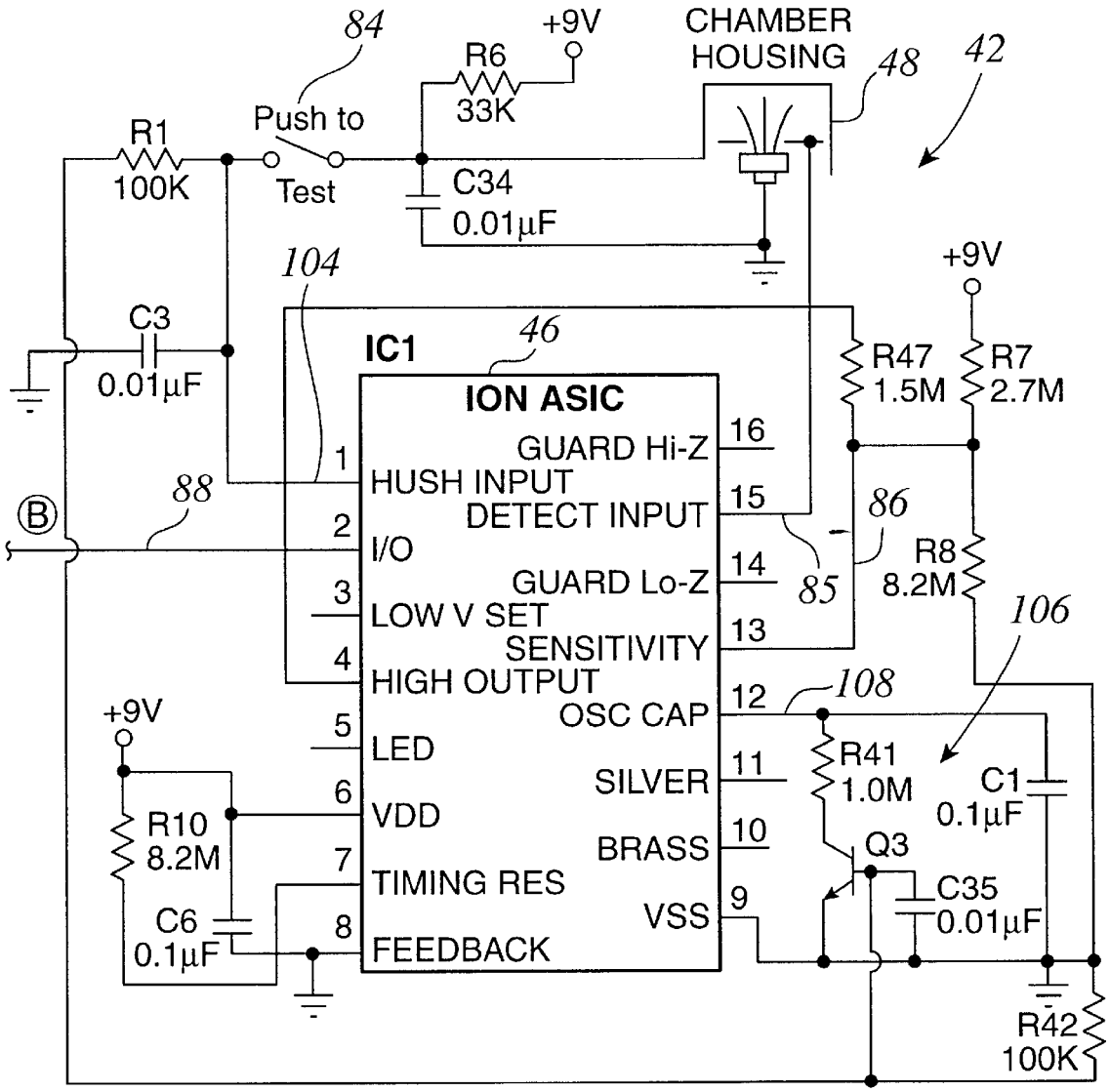

Referring now to FIGS. 4*a*–4*c*, thereshown is a detailed circuit schematic of the preferred embodiment of the invention, which corresponds to the second embodiment illustrated in FIG. 3. As discussed in FIG. 3, the photoelectric detector 44 functions as the "master", while the ionization detector 42 functions as the "slave." In the embodiment of the invention illustrated in FIGS. 4*a*–4*c*, the photoelectric detector 44 was selected as the "master" in order to take advantage of the included functionality contained within the photo control circuit 50. In the preferred embodiment of the invention, the photo control circuit 50 is an ASIC device having a model number A5366CA and purchased from Allegro Microsystems, Inc., of Worcester, Mass., the pin designations of which are shown for illustrative purposes only.

As illustrated in FIGS. 4*a*–4*c*, the ionization control circuit 46 of the ionization detector 42 is coupled to the photo control circuit 50 of the photoelectric detector 44. In the preferred embodiment of the invention, the ionization control circuit 46 is an ASIC device, such as model number A5368CA and purchased from Allegro Microsystems, Inc., the pin designations of which are shown in FIG. 4*c* for illustrative purposes only.

Referring now to FIG. 4*c*, the ionization control circuit 46 has its detector input pin 85 connected to the center electrode, also known as the collector plate of the ionization detector chamber 48. The ionization detector chamber 48 is connected through resistor R6 to the power supply circuit, which provides approximately nine volts. When ionized particles created by a smoke condition are sensed within the ionization detector chamber 48, the voltage at the detector input pin 85 changes. The ionization control circuit 46 compares the detector input pin voltage to an internal threshold value controlled by the sensitivity pin 86 and generates an alarm when the voltage at the detector input pin 15 reaches the threshold value. The input to the sensitivity pin 86 is controlled by the voltage divider consisting of resistors R7 and R8, in conjunction with additional resistors having a similar function that are internal to ASIC 46.

In a typical application of only the ionization control circuit 46, an alarm condition would cause the ionization control circuit 46 to activate an audible alarm connected to pins 8, 10, and 11 and at the same time generate a high output at the I/O pin 88. However, in the preferred embodiment of the invention illustrated in FIG. 4*c*, an audible alarm is not connected to the ionization control circuit 46. Instead, the ionization control circuit 46 communicates the high alarm signal on the I/O pin 88 to the test pin 90 (FIG. 4*b*) of the photo control circuit 50 through resistor R45.

Upon receiving the high signal on the test pin 90, the photo control circuit 50 increases the gain within the photo control circuit 50 at the detector input pin 100 to simulate a potential fire condition. Upon sensing the simulated potential fire condition, the photo control circuit 50 activates the audible alarm 56 to indicate that an alarm condition has occurred. The audible alarm 56 will continue to operate as long as the ionization control circuit 46 senses a potential fire condition and generates a high alarm signal on its I/O pin 88. In this manner, the ionization control circuit 46 causes the photo control circuit 50 to generate an audible alarm when the ionization detector chamber 48 senses a potential fire.

Referring now to FIG. 4*a*, the photoelectric detector 44 includes the photo detector chamber having an infrared emitter 94 and the photo receptor diode 92. The infrared emitter 94 is connected to the power supply through resistor R35 and is pulsed on and off by the activation of transistor Q1. The base of transistor Q1 is connected to an infrared pin 96 of the photo control circuit 50. When the infrared emitter 94 is pulsed on by a high signal at infrared pin 96, which is applied to the base of transistor Q1, a portion of the infrared light is reflected by smoke particles in the photo detector chamber and is sensed by the photo receptor diode 92, also contained within the photo detector chamber. As the photoreceptor diode 92 detects reflected infrared radiation, the photodiode 92 generates a small current that is proportional to the infrared energy. This current is applied to resistor R29, generating a subsequent proportional voltage, causing the voltage at the detector pin 100 to change as well.

When the photo control circuit 50 senses that the voltage at the detector pin 100 has reached a predetermined value, the photo control circuit 50 generates an alarm signal that activates the audible alarm 56. In addition to activating the audible alarm 56, the photo control circuit 50 also generates a high signal on the I/O pin 102, which is transferred to the multiple station interconnect 74, as illustrated in FIG. 4*b*. The multiple station interconnect 74 allows the alarm signal at the I/O pin 102 to be transferred to other smoke alarms connected to the smoke alarm circuit illustrated in FIGS. 4*a*–4*c*. In this manner, multiple smoke alarms can be activated when any one of the smoke alarms detects a potential fire condition.

Referring back to FIG. 4*c*, the smoke alarm circuit includes the test switch 84 that allows a user to test the operation of the smoke alarm of the present invention. When the test switch 84 is depressed during normal operating conditions in which a potential fire condition is not detected, a high signal is applied to the hush/input terminal 104 of the ionization control circuit 46. Simultaneously, due to the action of current flowing through R6, the switch 84, and R1 and the input current at pin 104, the voltage at the chamber housing 48 is reduced to a value that is approximately ⅔ of the normal potential. This change in housing potential is correspondingly reflected as a proportional change in voltage of the center electrode connected to pin 85 of ASIC 46, as is well known in the art of push-to-test switches on ionization smoke alarms. When the voltage at pin 85 reaches the value of the reference, or comparison voltage at pin 86, the ionization control circuit 46 generates an alarm signal that would typically drive an audible alarm connected to the ionization control circuit 46 and generates a high signal on the I/O pin 88. However, in the preferred embodiment of the invention illustrated in FIG. 4*c*, an audible alarm is not connected to the ionization control circuit 46. Instead, the ionization control circuit 46 is connected by its I/O pin 88 to the master photo control circuit 50.

An internal feature of the ionization control circuit 46 used in the preferred embodiment of the invention causes the high signal on the I/O pin 88 to be delayed for a period of approximately three seconds after the test switch 84 has been depressed. This internal feature of the ionization control circuit 46 allows a user to test an individual smoke alarm without activating all of the smoke alarms joined to each other by the multiple station interconnects typically attached to each I/O pin of the individual control circuit.

In the embodiment of the invention illustrated in FIG. 4*c*, a test circuit 106 is connected to pin 108 to adjust the internal timing within the ionization control circuit 46 such that a high signal is present on the I/O pin 88 in much less than three seconds. When the test switch 84 is pressed, a high signal is applied to the base of transistor Q3 through the resistor R1. This high signal at the base of transistor Q3 turns transistor Q3 on and essentially inserts the resistor R41 between pin 108 and ground. The resistor R41 changes the frequency of the internal oscillator in the ionization control circuit 46 and decreases the three-second delay between depression of the test switch 84 and the high signal on I/O pin 88. Thus, upon depression of the test switch 84, the high alarm signal is present on the I/O pin 88 in much less than three seconds. The high signal on pin 88 is applied to the test pin 90 of the photo control circuit 50, which causes the photo control circuit 50 to generate an alarm signal and activate the audible alarm 56. In this manner, the test circuit 106 connected to the pin 108 of the ionization control circuit 46 allows the ionization control circuit 46 to almost immediately generate a high signal at I/O pin 88 and cause the photo control circuit 50 to activate the audible alarm.

Referring back to FIG. 4*b*, thereshown is the dual power supply circuit 62 that operates the smoke alarm of the present invention. As can be seen in FIG. 4*b*, the power supply circuit 62 includes a "hot" connection 110 and a "neutral" connection 112 to the AG power supply 68. The AC power supply 68 is regulated to approximately 11 volts by the zener diode Z1. The regulated AC voltage activates the AC power LED 70 to indicate that AC power is present in the power supply circuit 62. Preferably, the AC power LED 70 is visible from outside the housing of the smoke alarm to allow the user to quickly determine whether AC power is present.

The regulated AC power forward biases diode D1, is filtered by C36, and the regulated voltage minus the voltage drop across diode D1 is supplied to the collector of transistor Q2. The base of transistor Q2 is connected to the collector through a resistor R44. Thus, when AC power is present, the transistor Q2 is turned on and the regulated AC voltage minus the voltage drop across the transistor is present at the emitter of transistor Q2. The voltage at the emitter of transistor Q2 forward biases the diode D2 and this voltage, minus the voltage drop across diode D2, creates the power supply VDD. Typically, the voltage VDD supplied by the AC power supply is moderately greater than 9 volts. The power supply VDD is connected to the voltage supply and detection pin 115 of the photo control circuit 50, which allows the photo control circuit 50 to monitor the value of the power supply voltage.

When AC power is present, the voltage at the supply node 114 is slightly greater than the voltage of the battery 66, which reverse biases the diode D3 and prevents the battery DC power supply 66 from discharging through the power supply circuit 62. However, if the AC power supply 68 is interrupted, the voltage supplied by the AC power supply to the supply terminal 114 is eliminated and the DC power supply 66 forward biases diode D3, causing the power supply terminal 114 to equal the DC power supply 66 minus the forward voltage drop of D3. In this manner, the power supply circuit 62 allows the power supply terminal 114 to be supplied by the AC power supply 68 during normal operating conditions and allows the back-up DC power supply 66 to supply power when the AC power is interrupted.

As can be seen in FIG. 4*b*, the base of transistor Q2 is connected to the LED terminal 116 of the photo control circuit 50 through the zener diode Z3. When the photo control circuit 50 pulses the red LED 118, the low voltage on LED pin 116 causes the base of transistor Q2 to be pulled to a voltage that is approximately the sum of LED pin 116 (approximately 0.5 volt) and the 7.5 volts of the zener diode Z3. The reduced voltage at the base of transistor Q2 causes the voltage at the emitter to drop approximately 0.7 volt below the base, which is approximately 7.3 volts. The 7.3 volts at the emitter of transistor Q2 is further reduced by the forward drop of diode D2 to approximately 6.6 volts and causes the voltage at supply terminal 114 to fall below the known level of the lowest acceptable battery voltage. Since the battery voltage of a good battery is greater than the voltage at the emitter of transistor Q2 during the condition when the red LED 118 is enabled, the battery DC power supply voltage 66 is present at the supply terminal 114, which is connected to the voltage detection pin 115 of the photo control circuit 50. The photo control circuit 50 can thus monitor the level of the DC power supply 66 each time the LED 118 is pulsed.

Although a detailed discussion of various components illustrated in the preferred embodiment of the invention of FIGS. 4*a*–4*c* has been omitted, these circuit elements and configurations are well known to those skilled in the art and are common connections, some of which are specified by the manufacturers of the photo control circuit 50 and the ionization control circuit 46. In FIGS. 4*a*–4*c*, specific values for the components of the smoke alarm circuitry are specified, although it should be understood that various values could be substituted for those specified while still operating within the scope of the invention. It should be understood that FIGS. 4*a*–4*c* constitute only the present preferred embodiment of the invention and various other specific configurations for a smoke alarm including dual sensing technologies and dual power supplies could be designed while operating within the scope of the present invention.

We claim:

1. A smoke alarm for generating an alarm in response to a sensed, potential fire comprising:

a photoelectric detector having a photoelectric detector chamber for detecting a potential fire and a photo control circuit for generating a first alarm signal upon detection of a potential fire;

an ionization detector having an ionization detector chamber for detecting a potential fire and an ionization control circuit for generating a second alarm signal upon detection of a potential fire;

an audible alarm that activates upon generation of the first alarm signal or the second alarm signal;

an AC power supply that supplies power to the control circuit of both the photoelectric detector and the ionization detector; and a DC power supply that supplies power to the control circuit of both the photoelectric detector and the ionization detector, wherein the DC power supply operates the smoke alarm only when the AC power supply is inoperable;

wherein the ionization control circuit of the ionization detector is coupled to the photo control circuit of the photoelectric detector to receive the first alarm signal from the photo control circuit such that the ionization control circuit activates the audible alarm upon generation of the first alarm signal or the second alarm signal.

2. A smoke alarm for generating an alarm in response to a sensed, potential fire comprising:

a photoelectric detector having a photoelectric detector chamber for detecting a potential fire and a photo control circuit for generating a first alarm signal upon detection of a potential fire;

an ionization detector having a ionization detector chamber for detecting a potential fire and an ionization control circuit for generating a second alarm signal upon detection of a potential fire;

an audible alarm that activates upon generation of the first alarm signal or the second alarm signal; and a power supply circuit including an AC power supply and a DC power supply, wherein the power supply circuit supplies AC power to the ionization control circuit and the photo control circuit during normal operating conditions and supplies DC power to the ionization control circuit and the photo control circuit when the AC power supply is interrupted;

wherein the ionization control circuit of the ionization detector is coupled to the photo control circuit of the photoelectric detector to receive the first alarm signal from the photo control circuit such that the ionization control circuit activates the audible alarm upon generation of the first alarm signal or the second alarm signal.

3. A smoke alarm for generating an alarm in response to a sensed, potential fire comprising:

a photoelectric detector having a photoelectric detector chamber for detecting a potential fire and a photo control circuit for generating a first alarm signal upon detection of a potential fire;

an ionization detector having an ionization detector chamber for detecting a potential fire and an ionization control circuit for generating a second alarm signal upon detection of a potential fire;

an audible alarm that activates upon generation of the first alarm signal or the second alarm signal;

an AC power supply that supplies power to the control circuit of both the photoelectric detector and the ionization detector; and a DC power supply that supplies power to the control circuit of both the photoelectric detector and the ionization detector, wherein the DC power supply operates the smoke alarm only when the AC power supply is inoperable;

wherein the photo control circuit of the photoelectric detector is coupled to the ionization control circuit of the ionization detector to receive the second alarm signal from the ionization control circuit such that the photo control circuit activates the audible alarm upon generation of the first alarm signal or second alarm signal.

4. The smoke alarm of claim 1 further comprising an interconnect terminal coupled to the ionization control circuit of the ionization detector, the interconnect terminal allowing multiple smoke alarms to be interconnected, wherein the ionization control circuit energizes the interconnect terminal upon generation of the first alarm signal or the second alarm signal.

5. The smoke alarm of claim 3 further comprising an interconnect terminal coupled to the photo control circuit of the ionization detector, the interconnect terminal allowing multiple smoke alarms to be interconnected, wherein the photo control circuit energizes the interconnect terminal upon generation of the first alarm signal or the second alarm signal.

6. The smoke alarm of claim 4 further comprising a test button coupled to the photo control circuit, wherein when the test button is depressed, the photo control circuit generates the first alarm signal such that the ionization control circuit activates the audible alarm.

7. The smoke alarm of claim 5 further comprising a test button coupled to the ionization control circuit, wherein the ionization control circuit generates the second alarm signal such that the photo control circuit activates the audible alarm.

8. A smoke alarm for generating an alarm in response to a sensed, potential fire comprising:

a photoelectric detector having a photoelectric detector chamber for detecting a potential fire and a photo control circuit for generating a first alarm signal upon detection of a potential fire;

an ionization detector having a ionization detector chamber for detecting a potential fire and an ionization control circuit for generating a second alarm signal upon detection of a potential fire;

an audible alarm that activates upon generation of the first alarm signal or the second alarm signal; and a power supply circuit including an AC power supply and a DC power supply, wherein the power supply circuit supplies AC power to the ionization control circuit and the photo control circuit during normal operating conditions and supplies DC power to the ionization control circuit and the photo control circuit when the AC power supply is interrupted;

wherein the photo control circuit of the photoelectric detector is coupled to the ionization control circuit of the ionization detector to receive the second alarm signal from the ionization control circuit such that the photo control circuit activates the audible alarm upon generation of the first alarm signal or second alarm signal.

9. The smoke alarm of claim 2 further comprising an interconnect terminal coupled to the ionization control circuit of the ionization detector, the interconnect terminal allowing multiple smoke alarms to be interconnected, wherein the ionization control circuit energizes the interconnect terminal upon generation of the first alarm signal or the second alarm signal.

10. The smoke alarm of claim 8 further comprising an interconnect terminal coupled to the photo control circuit of the ionization detector, the interconnect terminal allowing multiple smoke alarms to be interconnected, wherein the photo control circuit energizes the interconnect terminal upon generation of the first alarm signal or the second alarm signal.

11. The smoke detector of claim 9 further comprising a test button coupled to the photo control circuit, wherein when the test button is depressed, the photo control circuit generates the first alarm signal such that the ionization control circuit activates the audible alarm.

12. The smoke alarm of claim 10 further comprising a test button coupled to the ionization control circuit, wherein the ionization control circuit generates the second alarm signal such that the photo control circuit activates the audible alarm.

* * * * *